US010221641B2

(12) United States Patent
Zhang et al.

(10) Patent No.: US 10,221,641 B2
(45) Date of Patent: Mar. 5, 2019

(54) DOWNHOLE TOOLS HAVING CONTROLLED DEGRADATION AND METHOD

(71) Applicants: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(72) Inventors: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/599,101

(22) Filed: May 18, 2017

(65) Prior Publication Data

US 2018/0283141 A1 Oct. 4, 2018

Related U.S. Application Data

(63) Continuation-in-part of application No. 15/472,382, filed on Mar. 29, 2017.

(51) Int. Cl.
*E21B 29/02* (2006.01)
*E21B 41/00* (2006.01)
(Continued)

(52) U.S. Cl.
CPC ..... *E21B 29/02* (2013.01); *E21B 23/04* (2013.01); *E21B 29/00* (2013.01); *E21B 31/002* (2013.01);
(Continued)

(58) Field of Classification Search
CPC ..... E21B 29/00; E21B 29/02; E21B 34/16
See application file for complete search history.

(56) References Cited

U.S. PATENT DOCUMENTS 6,253,843 B1 7/2001 Rawson et al.
7,270,191 B2 9/2007 Drummond et al.
(Continued)

FOREIGN PATENT DOCUMENTS

WO 2013022635 A2 2/2013

OTHER PUBLICATIONS

"Spectre Disintegrating Frac Plug", Baker Hughes, 2015, 8 Pages.
(Continued)

*Primary Examiner* — Giovanna C. Wright
*Assistant Examiner* — Tara E Schimpf
(74) *Attorney, Agent, or Firm* — Cantor Colburn LLP

(57) ABSTRACT

A downhole assembly includes a matrix material and a unit in contact with the matrix material. The unit includes a core having an energetic material, an activator disposed in direct contact with the core, and at least one layer disposed on the core. The activator includes a triggering system having an igniter and a pre-set timer connected in an electrical circuit. The igniter is inactive in an open condition of the electrical circuit, and, after a pre-set time period, the pre-set timer closes the electrical circuit and the igniter is activated.

22 Claims, 7 Drawing Sheets

(51) Int. Cl.

| | |
|---|---|
| ***E21B 23/04*** | (2006.01) |
| ***E21B 31/00*** | (2006.01) |
| ***E21B 31/107*** | (2006.01) |
| ***E21B 41/02*** | (2006.01) |
| ***E21B 29/00*** | (2006.01) |
| *E21B 23/03* | (2006.01) |
| *E21B 33/037* | (2006.01) |
| *C22C 18/00* | (2006.01) |
| *C22C 19/00* | (2006.01) |
| *E21B 34/06* | (2006.01) |

(52) U.S. Cl.

CPC ..... *E21B 31/1075* (2013.01); *E21B 41/0085* (2013.01); *E21B 41/02* (2013.01); *C22C 18/00* (2013.01); *C22C 19/00* (2013.01); *E21B 23/03* (2013.01); *E21B 31/107* (2013.01); *E21B 33/0375* (2013.01); *E21B 34/066* (2013.01)

(56) References Cited

U.S. PATENT DOCUMENTS

| | | | |
|---|---|---|---|
| 8,056,638 | B2 | 11/2011 | Clayton et al. |
| 8,235,102 | B1 | 8/2012 | Robertson |
| 8,256,521 | B2 | 9/2012 | Swor et al. |
| 8,272,446 | B2 | 9/2012 | Swor et al. |
| 8,291,969 | B2 | 10/2012 | Swor et al. |
| 8,291,970 | B2 | 10/2012 | Swor et al. |
| 8,322,449 | B2 | 12/2012 | Clayton et al. |
| 8,327,926 | B2 | 12/2012 | Robertson |
| 8,403,037 | B2 | 3/2013 | Agrawal et al. |
| 8,528,633 | B2 | 9/2013 | Agrawal et al. |
| 9,022,107 | B2 | 5/2015 | Agrawal et al. |
| 9,101,978 | B2 | 8/2015 | Xu et al. |
| 9,267,347 | B2 | 2/2016 | Agrawal et al. |
| 2007/0209802 | A1 | 9/2007 | Xu et al. |
| 2013/0160992 | A1 | 6/2013 | Agrawal et al. |
| 2014/0014339 | A1* | 1/2014 | O'Malley ..... E21B 43/261 166/281 |
| 2014/0190685 | A1 | 7/2014 | Frazier et al. |
| 2014/0202712 | A1 | 7/2014 | Fripp et al. |
| 2014/0251612 | A1 | 9/2014 | Powers |
| 2014/0262327 | A1 | 9/2014 | Xu et al. |
| 2014/0363692 | A1 | 12/2014 | Marya et al. |
| 2015/0027723 | A1 | 1/2015 | Fripp et al. |
| 2015/0190984 | A1* | 7/2015 | Zhang ..... B32B 15/01 428/646 |
| 2015/0239795 | A1* | 8/2015 | Doud ..... C06B 45/32 428/649 |
| 2015/0259263 | A1 | 9/2015 | Shrerman et al. |
| 2015/0292288 | A1* | 10/2015 | Kasperski ..... E21B 27/02 166/285 |
| 2016/0209391 | A1 | 7/2016 | Zhang et al. |
| 2016/0333668 | A1 | 11/2016 | Xu et al. |
| 2017/0009563 | A1 | 1/2017 | Holder |
| 2018/0171736 | A1 | 6/2018 | Xu et al. |
| 2018/0171737 | A1 | 6/2018 | Xu et al. |
| 2018/0171738 | A1 | 6/2018 | Xu et al. |
| 2018/0171757 | A1 | 6/2018 | Xu |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US2017/062286, dated Mar. 13, 2018, 7 pages.

Written Opinion of the International Search Report for International Application No. PCT/US2017/062286, dated Mar. 13, 2018, 11 pages.

* cited by examiner

DOWNHOLE TOOLS HAVING CONTROLLED DEGRADATION AND METHOD

CROSS REFERENCE TO RELATED APPLICATIONS

The present application is a continuation-in-part of U.S. patent application Ser. No. 15/472,382, filed Mar. 29, 2017, which is hereby incorporated by reference in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating downhole tools have been developed. Instead of milling or drilling operations, these tools can be removed by dissolution of engineering materials using various wellbore fluids. One challenge for the self-disintegrating downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainly associated with the disintegration period can cause difficulties in well operations and planning. An uncontrolled disintegration can also delay well productions. Therefore, the development of downhole tools that can be disintegrated on-demand is very desirable.

BRIEF DESCRIPTION

A downhole assembly includes a matrix material and a unit in contact with the matrix material. The unit includes a core having an energetic material, an activator disposed in direct contact with the core, and at least one layer disposed on the core. The activator includes a triggering system having an igniter and a pre-set timer connected in an electrical circuit. The igniter is inactive in an open condition of the electrical circuit, and, after a pre-set time period, the pre-set timer closes the electrical circuit and the igniter is activated.

A method of controllably removing a downhole article of a downhole assembly, the method including: setting a timer of the downhole article for a first time period, the downhole article including a degradable-on-demand material having a matrix material and a unit in contact with the matrix material, the unit including a core formed of an energetic material, a triggering system in direct contact with the core, and at least one layer on the core, the energetic material configured to generate energy upon activation to facilitate the degradation of the downhole article; disposing the downhole assembly in a downhole environment; performing a downhole operation using the downhole article during a second time period shorter than the first time period; activating the energetic material at the end of the first time period using an igniter of the triggering system; and degrading the downhole article.

A downhole assembly including: a tubing string having a flowbore; and, a fluid loss control flapper pivotally connected to the tubing string at a hinge, the flapper formed of a degradable-on-demand material including: a matrix material; and, a unit in contact with the matrix material, the unit including: a core comprising an energetic material; and, an activator disposed in direct contact with the core, the activator including a triggering system having an igniter and a pre-set timer connected in an electrical circuit; wherein the igniter is inactive in an open condition of the electrical circuit, and, after a pre-set time period, the pre-set timer closes the electrical circuit and the igniter is activated.

A frac plug including at least one component formed of a degradable-on-demand material including: a matrix material; and, a unit in contact with the matrix material, the unit including: a core including an energetic material; and, an activator disposed in direct contact with the core, the activator including a triggering system having an igniter and a pre-set timer connected in an electrical circuit; wherein the igniter is inactive in an open condition of the electrical circuit, and, after a pre-set time period, the pre-set timer closes the electrical circuit and the igniter is activated.

BRIEF DESCRIPTION OF THE DRAWINGS

The following descriptions should not be considered limiting in any way. With reference to the accompanying drawings, like elements are numbered alike:

FIG. 8A illustrates the triggering system in an inactive state and FIG. 8B illustrates the triggering system in an active state;

DETAILED DESCRIPTION

Figure 1:
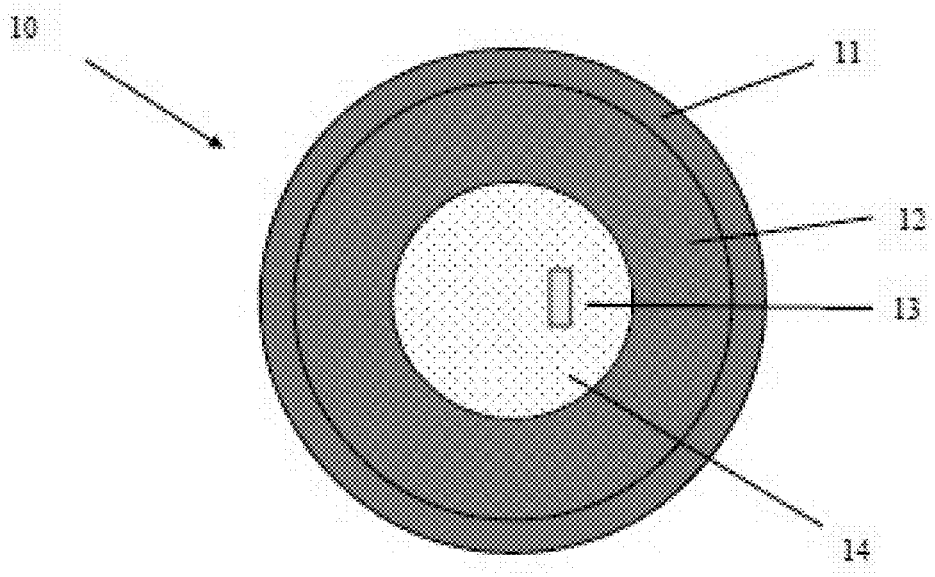
FIG. 1 is a cross-sectional view of an exemplary multilayered unit according to an embodiment of the disclosure.

The disclosure provides a multilayered unit that can be embedded in a downhole article, attached to a downhole article, or disposed between two adjacent components of a downhole assembly. The downhole article or downhole assembly containing the multilayered unit has controlled degradation, including partial or full disintegration, in a downhole environment. The controlled degradation, and more particularly the controlled disintegration, is implemented through integrating a high-strength matrix material with energetic material that can be triggered on demand for rapid tool disintegration.

The multilayered unit includes a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

The multilayered unit can have various shapes and dimensions. In an embodiment, the multilayered unit has at least one stress concentration location to promote disintegration. As used herein, a stress concentration location refers to a location in an object where stress is concentrated. Examples of stress concentration locations include but are not limited to sharp corners, notches, or grooves. The multilayered unit can have a spherical shape or an angular shape such as a triangle, rhombus, pentagon, hexagon, or the like. The multilayered unit can also be a rod or sheet. The matrix around the multilayered unit can also have stress concentration locations.

The energetic material comprises a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermite materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

As used herein, the activator is a device that is effective to generate spark, electrical current, or a combination thereof to active the energetic material. The activator can be triggered by a preset timer, characteristic acoustic waves generated by perforations from following stages, a pressure signal from fracking fluid, or an electrochemical signal interacting with the wellbore fluid. Other known methods to activating an energetic material can also be used.

The multilayered unit has a support layer to hold the energetic materials together. The Support layer can also provide structural integrity to the multilayered unit.

The multilayered unit has a protective layer so that the multilayered unit does not disintegrate prematurely during the material fabrication process. In an embodiment, the protective layer has a lower corrosion rate than the support layer when tested under the same testing conditions. The support layer and the protective layer each independently include a polymeric material, a metallic material, or a combination comprising at least one of the foregoing. The polymeric material and the metallic material can corrode once exposed to a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the support layer comprises the metallic material, and the protective layer comprises the polymeric material. In another embodiment, the support layer comprises the polymeric material, and the protective layer comprises the metallic material. In yet another embodiment, both the support layer and the protective layer comprise a polymeric material. In still another embodiment, both the support layer and the protective layer comprise a metallic material.

Exemplary polymeric materials include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

The metallic material can be a corrodible metallic material, which includes a metal, a metal composite, or a combination comprising at least one of the foregoing. As used herein, a metal includes metal alloys.

Exemplary corrodible metallic materials include zinc metal, magnesium metal, aluminum metal, manganese metal, an alloy thereof, or a combination comprising at least one of the foregoing. In addition to zinc, magnesium, aluminum, manganese, or alloys thereof, the corrodible material can further comprise a cathodic agent such as Ni, W, Mo, Cu, Fe, Cr, Co, an alloy thereof, or a combination comprising at least one of the foregoing to adjust the corrosion rate of the corrodible material. The corrodible material (anode) and the cathodic agent are constructed on the microstructural level to form μm-scale galvanic cells (micro-galvanic cells) when the material are exposed to an electrolytic fluid such as downhole brines. The cathodic agent has a standard reduction potential higher than −0.6 V. The net cell potential between the corrodible material and cathodic agent is above 0.5 V, specifically above 1.0 V.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The corrodible metallic material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

In an embodiment, the metallic material comprises Al, Mg, Zn. Mn, Fe, an alloy thereof, or a combination comprising at least one of the foregoing. In specific embodiments, the metallic material comprises aluminum alloy, magnesium alloy, zinc alloy, iron alloy, or a combination comprising at least one of the foregoing. In the instance wherein both the support layer and the protective layer comprise a metallic material, the metallic materials in the support layer and the protective layer are selected such that the support layer and the protective layer are easier to disintegrate when the energetic material is activated as compared to an otherwise identical unit except for containing only one metallic layer.

The core is present in an amount of about 5 to about 80 vol %, specifically about 15 to about 70 vol %; the support layer is present in an amount of about 20 to about 95 vol %, specifically about 30 to about 85; and the protective layer is present in an amount of about 0.1 to about 20 vol %, specifically about 1 to about 10 vol %, each based on the total volume of the multilayered unit.

FIG. 1 is a cross-sectional view of an exemplary multi-layered unit according to an embodiment of the disclosure. As shown in FIG. 1, unit 10 has a core 14, an activator 13 disposed in the core, a support layer 12 disposed on the core, and a protective layer 11 disposed on the support layer. Thus, in this embodiment, the unit 10 is a multi-layered unit.

The multilayered units can be embedded into different tools. The location and number of MLM units are selected to ensure that the whole tool can disintegrate into multiple pieces when the energetic material is activated. Thus in an embodiment, the disclosure provides a degradable article, and in particular a disintegrable article, comprising a matrix and a multilayered unit embedded therein. The matrix of the article can be formed from a corrodible metallic material as described herein. The matrix can further comprise additives such as carbides, nitrides, oxides, precipitates, dispersoids, glasses, carbons, or the like in order to control the mechanical strength and density of the articles if needed. In an embodiment, the matrix has pre-cracks including but not limited to pre-crack notches or pre-crack grooves around the multilayered unit to facilitate the quick degradation, and in particular the quick disintegration, of the article once the energetic material is activated.

Figure 2:
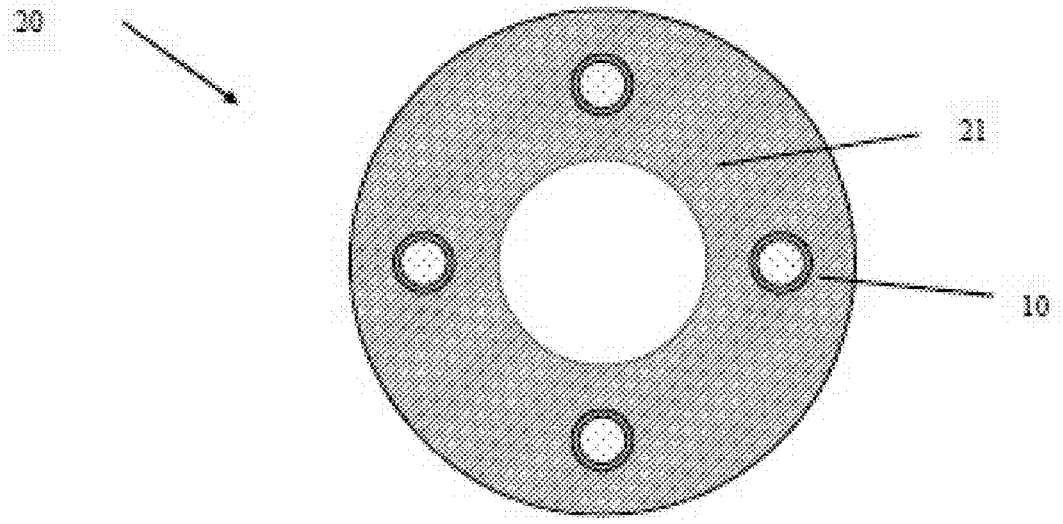
FIG. 2 is a cross-sectional view of an exemplary downhole article embedded with multilayered units.
Figure 3:
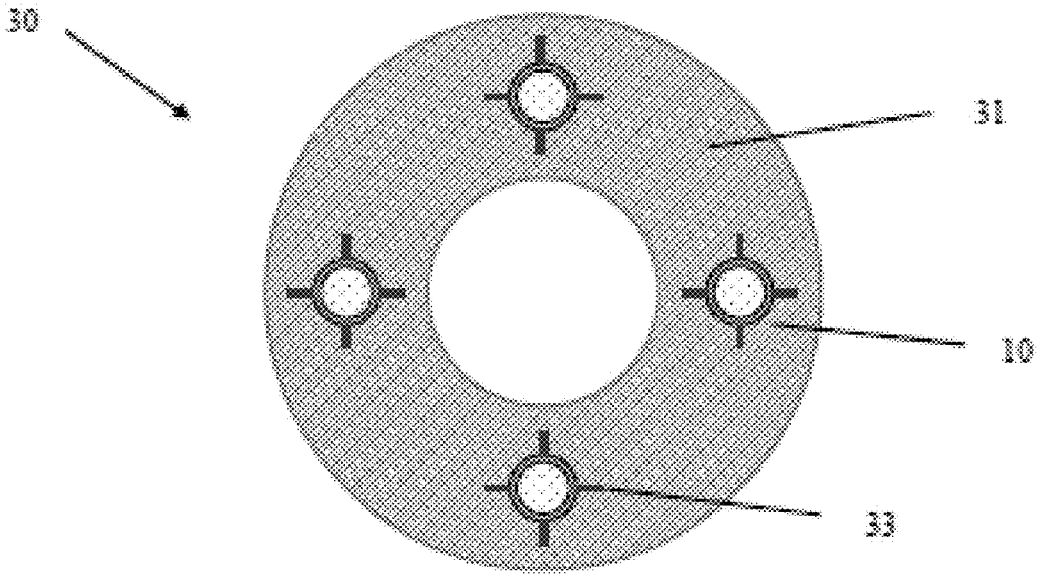
FIG. 3 is a cross-sectional view of another exemplary downhole article embedded with multilayered units, wherein the downhole article has pre-cracks around the multilayered units.
Figure 4:
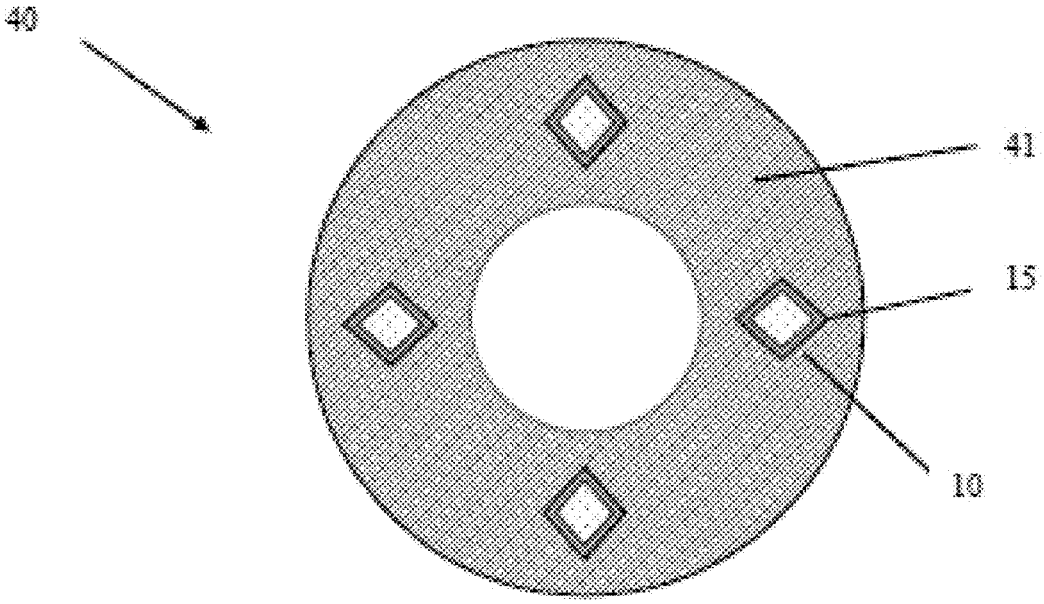
FIG. 4 is a cross-sectional view of yet another exemplary downhole article embedded with multilayered units, wherein the multilayered units and the matrix of the downhole article surrounding the multilayered units have stress concentration locations.
Figure 5:
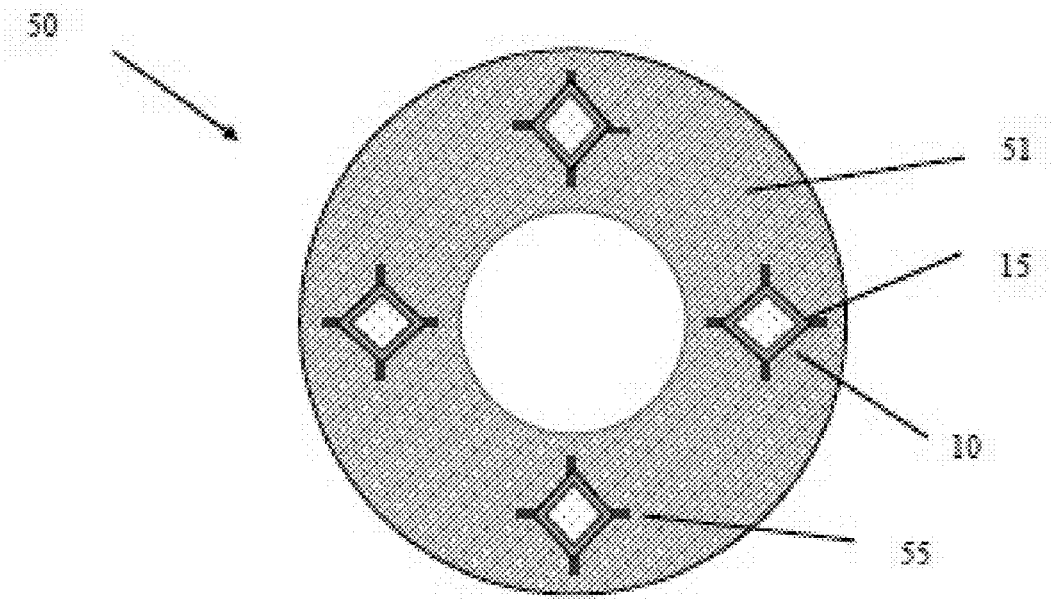
FIG. 5 is a cross-sectional view of still another exemplary downhole article embedded with multilayered units, wherein the multilayered units have stress concentration locations; and the downhole article matrix surrounding the multilayered unit has stress concentration locations as well as pre-cracks.

FIGS. 2-4 are cross-sectional views of various exemplary downhole articles embedded with multilayered units. In downhole article 20, multiple multilayered units 10 as described herein are embedded in matrix 21. In downhole article 30, multilayered units 10 are disposed in matrix 31, wherein matrix 31 has pre-cracks 33. In downhole article 40, multilayered units 10 are embedded in matrix 41, where the multilayered units have stress concentration locations 15. In downhole article 50, the multilayered units have stress concentration locations 15 and the matrix 51 has pre-cracks 55. In any of the above embodiments or combination of embodiments, the degradable-on-demand material includes the multi-layered units and the matrix to which the multi-layered units are in contact.

Degradable articles, and in particular disintegrable articles, are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, or a bridge plug.

A downhole assembly comprising a downhole article having a multilayered unit embedded therein is also provided. More than one component of the downhole article can be an article having embedded multilayered units.

The multilayered units can also be disposed on a surface of an article. In an embodiment, a downhole assembly comprises a first component and a multilayered unit disposed on a surface of the first component. The downhole assembly further comprises a second component, and the multilayer unit is disposed between the first and second components. The first component, the second component, or both can comprise corrodible metallic material as disclosed herein. Exemplary downhole assemblies include frac plugs, bridge plugs, and the like.

Figure 6:
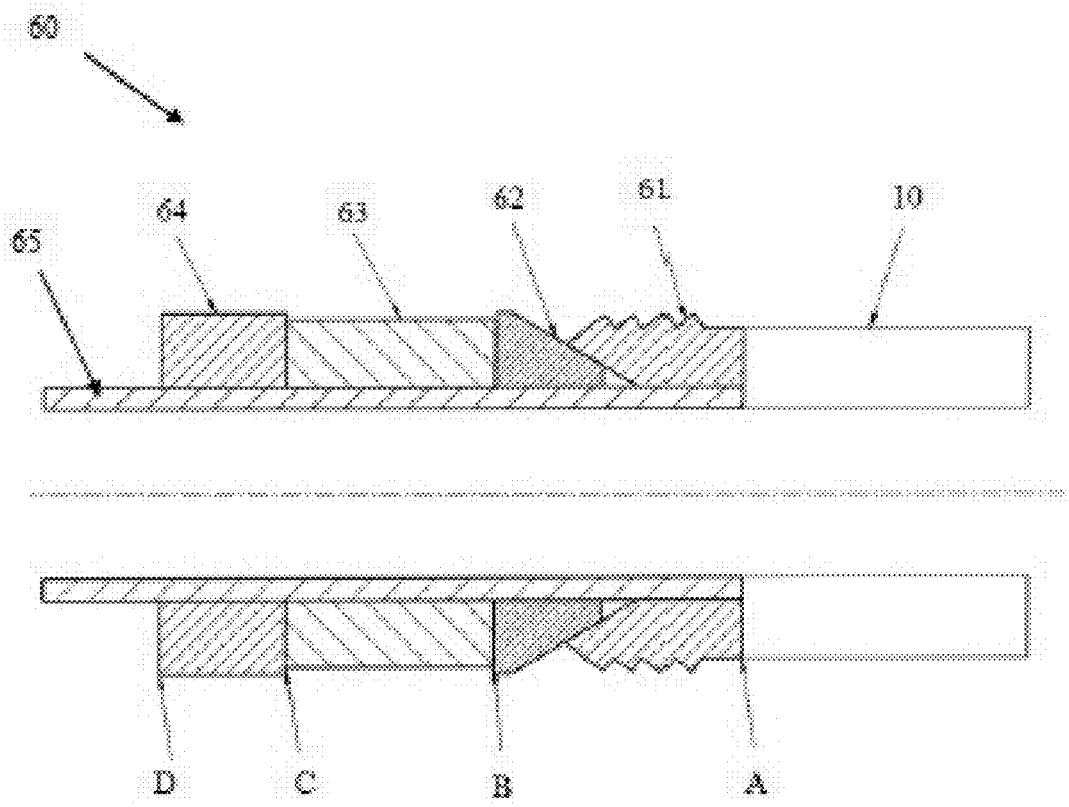
FIG. 6 schematically illustrates a downhole assembly having a multilayered unit attached to a component of the assembly or disposed between adjacent components of the assembly.

FIG. 6 schematically illustrates a downhole assembly having a multilayered unit attached to a component of the assembly or disposed between adjacent components of the assembly. As shown in FIG. 6, one embodiment of a downhole assembly 60 includes elements including an annular body 65 having a flow passage therethrough; a frustoconical element 62 disposed about the annular body 65; a sealing element 63 carried on the annular body 65 and configured to engage a portion of the frustoconical element 62; and a slip segment 61 and an abutment element 64 disposed about the annular body 65. While illustrated as individual elements, one or more of the elements of the downhole assembly 60 may be integrally combined, such as, but not limited to, annular body 65 and frustoconical element 62. Further, other embodiments of the downhole assembly 60 may include additional elements as required for particular operations. One or more of the frustoconical element 62, sealing element 63, abutment element 64, and slip segment 61 can have one or more embedded units 10, such as multi-layered units, as disclosed herein. That is, the unit 10 can be integrally combined with any one or more of the elements of the downhole assembly 60. Alternatively or in addition, unit 10 can be disposed on a surface of the slip segment 61 (position A), disposed on a surface of abutment element 64 (position D), between frustoconical element 62 and sealing element 63 (position B) or between sealing member 63 and abutment element 64 (position C).

Figure 7:
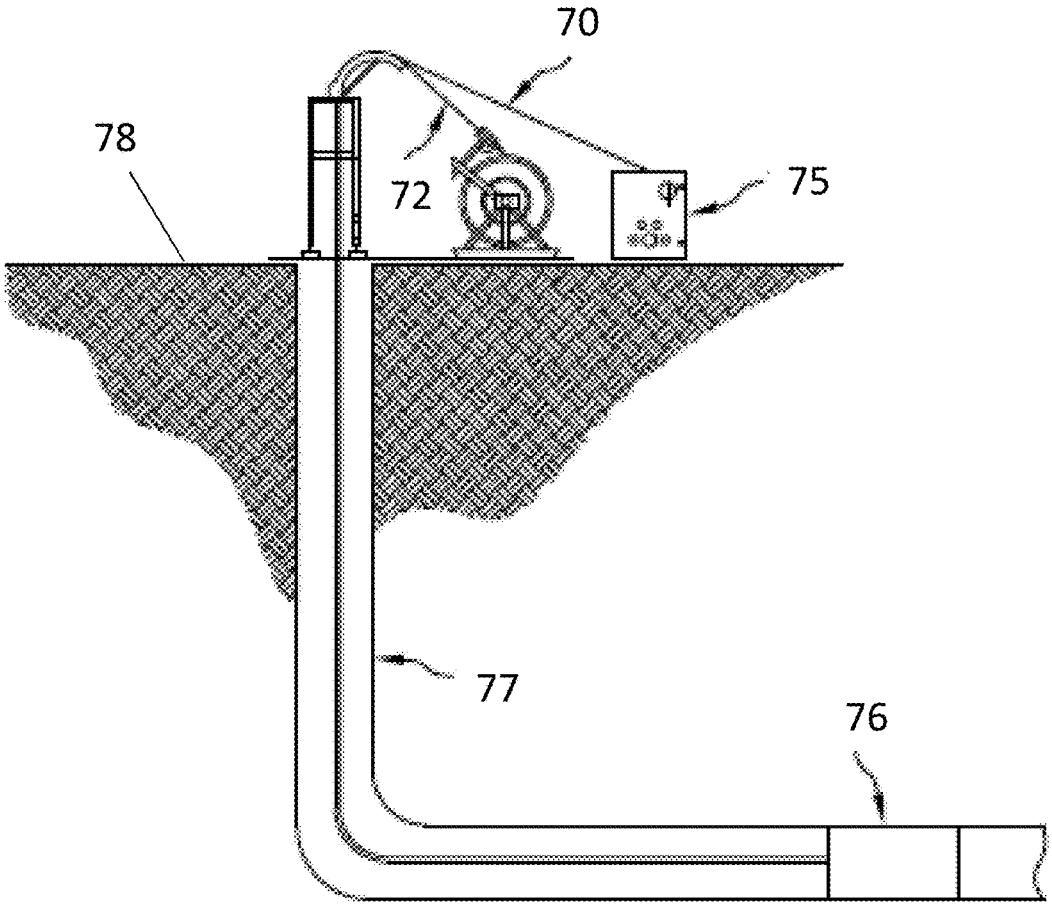
FIG. 7 is a schematic diagram illustrating a downhole assembly disposed in a downhole environment according to an embodiment of the disclosure.

Referring to FIG. 7, in one embodiment, a downhole assembly 76 is disposed in borehole 77 via a coil tubing or wireline 72. A communication line 70 couples the downhole assembly 76 to a processor 75. The communication line 70 can provide a command signal such as a selected form of energy from processor 75 to the downhole assembly 76 to activate the energetic material in the downhole assembly 76, such as by initiating activation of the activator 13 in at least one multi-layered unit 10 included in the downhole assembly 76. The communication line 70 can be optical fibers, electric cables or the like, and it can be placed inside of the coil tubing or wireline 72.

A method of controllably removing a downhole article or a downhole assembly comprises disposing a downhole article or a downhole assembly as described herein in a downhole environment; performing a downhole operation; activating the energetic material; and degrading, including full or partially disintegrating, the downhole article. A downhole operation can be any operation that is performed during drilling, stimulation, completion, production, or remediation. A fracturing operation is specifically mentioned. To start an on-demand degradation process, one multilayered unit is triggered and other units will continue the rapid degradation process following a series of sequenced reactions. The sequenced reactions might be triggered by pre-set timers in different units. Alternatively, the energetic material in one unit is activated and reacts to generate heat, strain, vibration, an acoustic signal or the like, which can be sensed by an adjacent unit and activate the energetic material in the adjacent unit. The energetic material in the adjacent unit reacts and generates a signal that leads to the activation of the energetic material in an additional unit. The process repeats and sequenced reactions occur.

Disintegrating the downhole article comprises breaking the downhole article into a plurality of discrete pieces. Advantageously, the discrete pieces can further corrode in the downhole fluid and eventually completely dissolve in the downhole fluid or become smaller pieces which can be carried back to the surface by wellbore fluids.

Figure 8A:
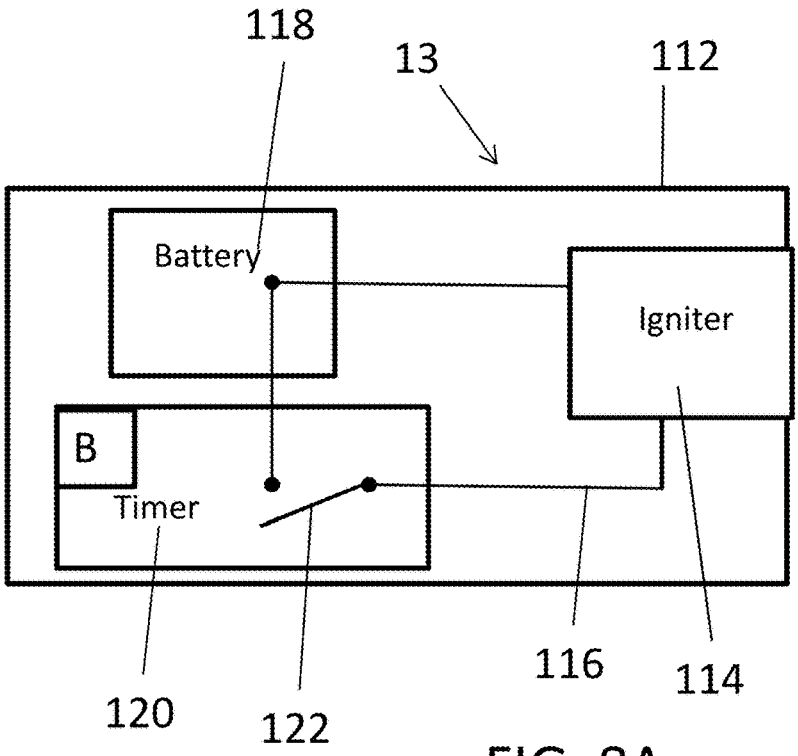
FIGS. 8A and 8B schematically illustrate an embodiment of an activator for the multilayered unit, the activator having a triggering system, where
Figure 8B:
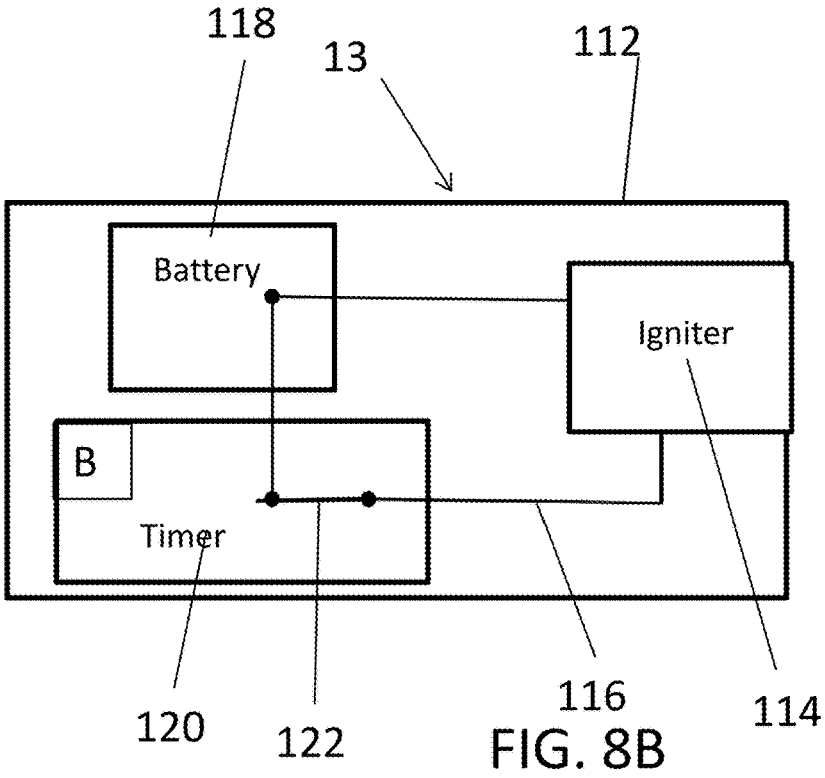

FIGS. 8A-8B illustrate an embodiment of an activator 13 for the unit 10, such as, but not limited to, the multi-layered unit. The activator 13 includes a triggering system 112. The triggering system 112 provides for operator-selected initiation of the ignition of the degradable downhole article having the degradable-on-demand material as described in the previous embodiments or combination of previous embodiments. In one embodiment, the triggering system 112 is provided within the core 14 of the unit 10. To provide easier operator access to the triggering system 112, the triggering system 112 may be disposed in the core 14 after the core 14 is formed. For example, the core 14 of energetic material may be formed with a receiving area and the triggering system 112 may be inserted into the receiving area in the core 14. Also, the layers 11, 12 may include an opening that aligns with the receiving area in the core 14, and the opening in the layers 11, 12 may be subsequently plugged. Alternatively, the unit 10 may be formed in sections, with the triggering system 112 insertable within a receiving area in the core 14 and the sections subsequently mated to trap the triggering system 112 therein. The degradable downhole article may be a portion of a downhole tool or may be an entire downhole tool, and a downhole assembly may be further provided that incorporates the downhole tool. The degradable-on-demand material does not begin degradation until a desired time that is chosen by an operator (as opposed to a material that begins degradation due to conditions within the borehole 77). In this embodiment, the time is chosen and pre-set by an operator by setting a timer 120, as will be further described below, however in other embodiments the degradable-on-demand material begins degradation upon receipt of a command signal from a communication line 70 (FIG. 7). The energetic material as previously described is located in the core 14 which also contains the activator 13. The degradable-on-demand material may further include the above-noted matrix material (21, 31, 41, 51) in which one or more of the unit 10 is contained or otherwise in contact. The activator 13 is contained in at least one of the one or more units 10. The downhole tool with the triggering system 112 incorporated within the degradable-on-demand material is thus a self-contained unit that can be run downhole, and the downhole tool can serve a downhole function prior to degradation, including full or partial disintegration.

In one embodiment, the triggering system 112 includes an igniter 114 arranged to directly ignite the energetic material in the core 14. The igniter 114 may also directly ignite another material that then ignites the core 14. In either case, the core 14 is ignited. In the illustrated embodiment, the triggering system 112 further includes an electrical circuit 116. In FIG. 8A, the circuit 116 is open so that the igniter 114 is not activated, not provided with electric current, and thus does not ignite the energetic material. In FIG. 8B, the circuit 116 is closed so that battery 118 starts to provide electric current to activate and set off the igniter 114, which ignites the energetic material in the core 14 and thus initiates the degradation of the remainder of the degradable-on-demand material within the downhole tool 110. Closure of the circuit 116 is enacted by the timer 120. While the battery 118 could be separately connected to the timer 120 for operation of the timer 120, the tinier 120 preferably includes its own separate battery B so that the battery 118 is dedicated to the igniter 114 to ensure sufficient energy release at the time of ignition. The timer 120 can be pre-set at surface 78 (see FIG. 7) or can be pre-set, and started, any time prior to running the downhole assembly having the downhole tool within the borehole 77, for a pre-selected time period. Methods described herein as setting the timer 120 also include starting the tinier 120. While the timer 120 can be set to close the switch 122 after any pre-selected time period, in one embodiment, the timer 120 is set to close the switch 122 after the expected completion of a procedure in which the downhole tool is utilized, such that the timer 120 is pre-set to have a time period to close switch 122 that is greater than an expected time period in which the downhole tool is utilized. That once the downhole tool 110 is no longer required, the circuit 116 can be closed in order to permit the battery 118 to then provide electric current to set off the igniter 114. As demonstrated by FIG. 8B, once the circuit 116 is in the closed condition, and igniter 114 is activated, heat is generated and transferred through the core 14, the layers, and the matrix material, and the degradable article within the downhole tool quickly but gradually degrades into small pieces due to the heat, such as pieces of an energetic material and a matrix material. The corrodible metallic material of the matrix material is designed to quickly degrade upon activation of the energetic material, as opposed to rupturing or exploding the article into pieces suddenly which could be harmful to surrounding downhole tools. Further, the degradable article of the downhole tool 110 does not begin the degradation process until a pre-selected time period ends, where the time period is not affected by other downhole conditions.

Figure 9:
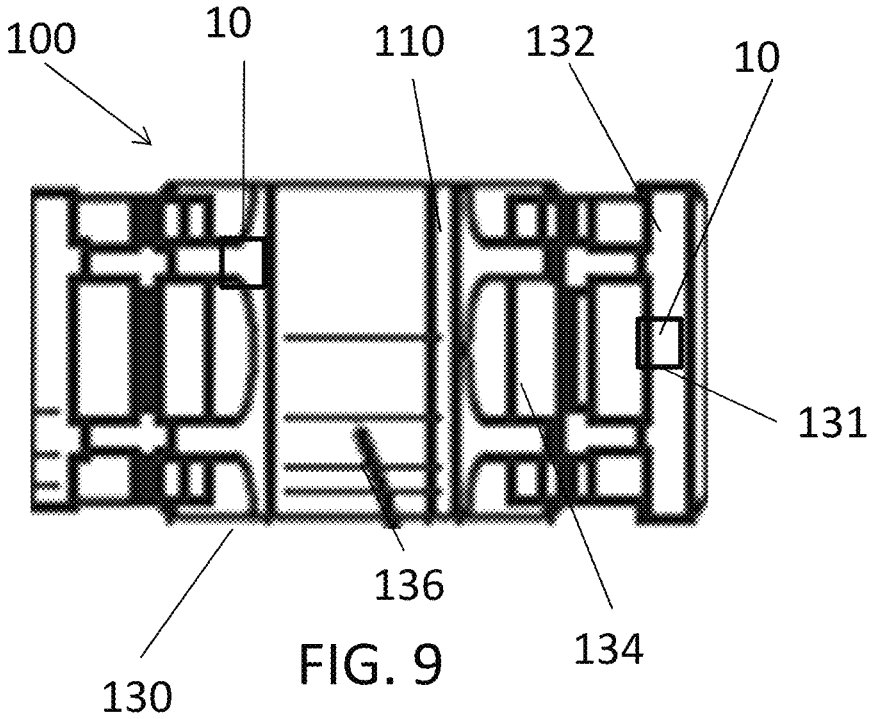
FIG. 9 schematically illustrates an embodiment of a downhole assembly including a frac plug formed at least partially of degradable-on-demand material; and, FIGS. 10A and 10B schematically illustrate an embodiment of a downhole assembly having a flapper valve having a flapper formed at least substantially of degradable-on-demand material, where

FIG. 9 shows one embodiment of a downhole assembly 100 where the downhole tool 110 is a frac plug 130. The frac plug 130 includes a body 132, slips 134, and a resilient member 136. One or more units 10 are provided within at least one portion of the frac plug 130, such as within a pocket 131 of the frac plug 130, or otherwise attached to or engaged directly with the frac plug 130. For example, the nit 10 is disposed in the body 132, and the body 132 is formed of the matrix material. The triggering system 112 as described with respect to FIGS. 8A and 8B may be provided in the activator 13 in one or more of the one or more units 10. At surface 78, the slips 134 and resilient member 136 have a first outer diameter which enables the frac plug 130 to be passed through the borehole 77, When the frac plug 130 reaches a desired location within the borehole 77, the frac plug 130 is set, such as by using a setting tool (not shown), to move the slips 134 radially outwardly to engage with an inner surface of the borehole 77 to prevent longitudinal movement of the frac plug 130 with respect to the borehole 77. Also, the resilient member 136 sealingly engages with the inner surface of borehole 77. When the frac plug 130 is no longer needed, such as after the completion of a plug and perf operation, the triggering system 112 can be initiated (such as due to the end of the pre-set time period) to ignite the units 10 from within, which will in turn degrade, including fully or at least substantially disintegrate, a remainder of the degradable-on-demand material used in the frac plug 130. In one embodiment, only select portions of the frac plug 130 are formed of the above-described degradable-on-demand material, such as, but not limited to the body 132. In another embodiment, other portions of the frac plug 130 are not formed of the degradable-on-demand material, however, such other portions may be formed of a different degradable material, such as, but not limited to, the above-described matrix material, that can be effectively and easily removed once the degradable article made of the degradable-on-demand material of the frac plug 130 has been substantially degraded during the degradation of the degradable article within the frac plug 130, or when heat from the degrading degradable-on-demand material ignites the degradable portion of the frac plug 130 that does not include the energetic material. When only one part of the frac plug 130 is made of degradable-on-demand material, such as, but not limited to the body 132 or cone (such as frustoconical element 62 shown in FIG. 6), the degradation of that part will eliminate the support to the other components such as, but not limited to, the slip 134. In this way, the frac plug 130 can collapse off from the casing to remove obstacle to flow path on-demand; in addition, degradable-on-demand material generates heat which can speed up the degradation of the rest of the frac plug 130.

Figure 10A:
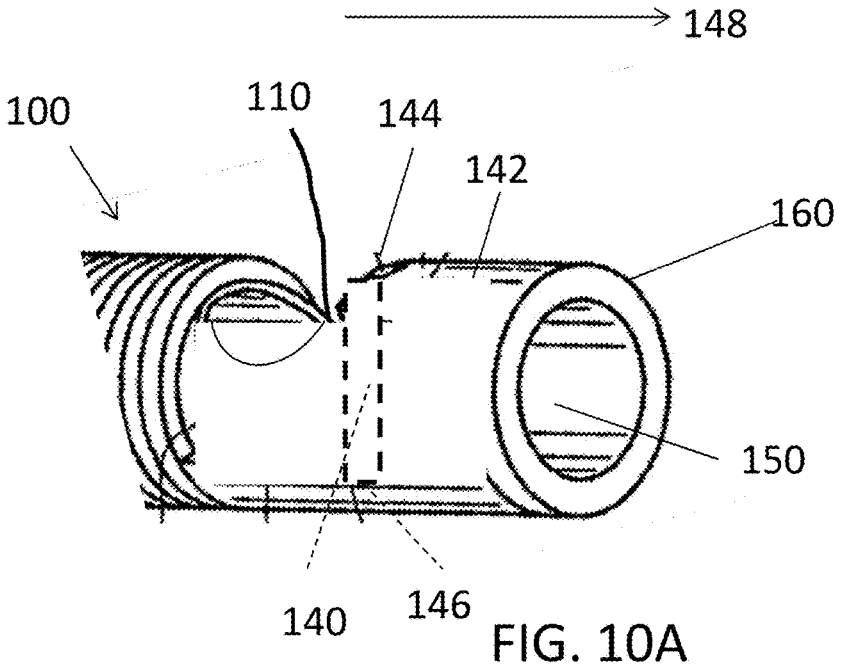
FIG. 10A illustrates the flapper in a closed condition.
Figure 10B:
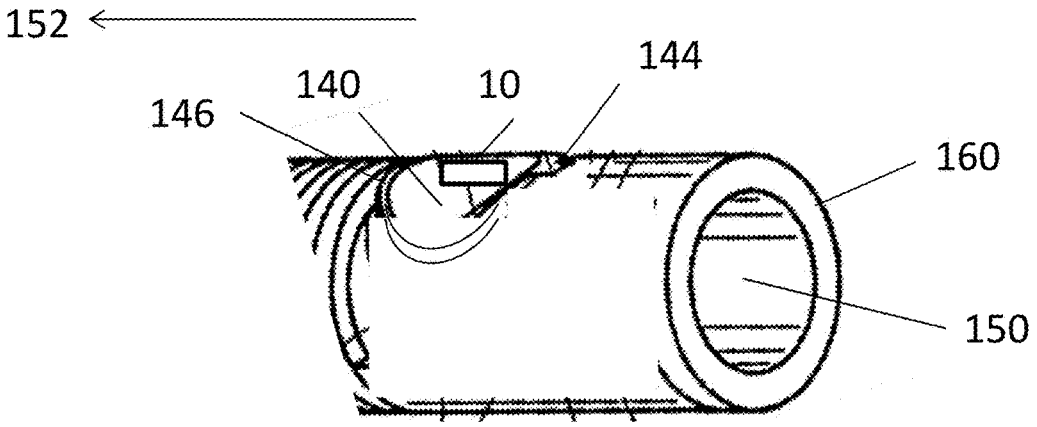
FIG. 10B illustrates the flapper in an open condition.

FIGS. 10A and 10B depict embodiments of the downhole assembly 100 where the downhole tool 110 is a fluid loss control valve 160 having a flapper 140. Flapper 140 is a plate-like member that is pivotally affixed at hinge 144 to one side of tubing string 142 and may be rotated 90 degrees between a closed position (FIG. 10A) where fluid flow is blocked through flowbore 150 in at least the downhole direction 148, and an open position (FIG. 10B) where fluid flow is permitted through flowbore 150. A spring member may be used to bias the flapper 140 toward its closed position, and may be opened using hydraulic fluid pressure. When the flapper 140 is incorporated into a fluid loss control valve 160 and wellbore isolation valve, the flapper 140 may be installed so that the flapper 140 must open by being pivoted upwardly (toward the opening of the well). As illustrated, a free end 146 of the flapper 140 is pivotally movable in a downhole direction 148 to close the flowbore 150 and the free end 146 is pivotally movable in an uphole direction 152 to open the flowbore 150. Conventionally, permanent removal of a fluid loss control valve flapper may be accomplished by breaking the flapper into fragments using mechanical force or hydraulic pressure, however an additional intervention trip would be required and broken pieces remaining in the well could pose potential problems. Thus, the flapper 140 includes the degradable-on-demand material. The degradable-on-demand material can be triggered or actuated remotely on a customer command (such as by, but not limited to, using communication line 70 shown in FIG. 7) to at least substantially degrade gradually (as opposed to a sudden rupture), and more particularly substantially fully disintegrate. The triggering signal may be electric current, or alternatively pressure pulse, high energy beam, as well as any of the other above-described embodiments. The degradable-on-demand material used to build the flapper 140 is a composite including the matrix (such as the previously described matrix 21, 31, 41, 51) and the energetic material (such as any of the above-described energetic material found in unit 10). The flapper 140 further includes a trigger, such as igniter 114 (see FIG. 8A) found in activator 13 of the unit 10 which is provided within the matrix of the flapper 140, such as in a pocket in the flapper 140. In another embodiment, the unit 10 may be attached to the flapper 140 as opposed to embedded therein. The igniter 114 is arranged to directly engage with the energetic material of the core 14 of the unit 10. The matrix provides the structural strength for pressure and temperature rating of the flapper 140. The energetic material once triggered provides the energy to degrade, including fully or partially disintegrate, the flapper 140. The activator 13 functions as a receiver for receiving an on-command (or pre-set) signal and to degrade the unit 10 and thus degrade the flapper 140. Signal can be sent remotely, such as from the surface 78 of the well, and at a selected time by the customer. The flapper 140 can alternatively include the triggering system 112 (FIG. 8A) within the activator 13 of the unit 10, where the time to trigger the degradation of the flapper 140 is pre-set using the timer 120. Also, while the flapper 140 has been described for use in a fluid loss control valve 160, the flapper 140 having the degradable-on-demand material may be utilized by other downhole assemblies.

Various embodiments of the disclosure include a downhole article including: a matrix; and a multilayered unit disposed in the matrix, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer. In any prior embodiment or combination of embodiments, the multilayered unit has at least one stress concentration location. In any prior embodiment or combination of embodiments, the matrix has a pre-crack around the multilayered unit. In any prior embodiment or combination of embodiments, the activator is a device that is effective to generate spark, electrical current, or a combination thereof to active the energetic material. In any prior embodiment or combination of embodiments, the energetic material includes a thermite, a thermate, a solid propellant fuel, or a combination including at least one of the foregoing. In any prior embodiment or combination of embodiments, the metallic material includes Zn, Mg, Al, Mn, iron, an alloy thereof, or a combination comprising at least one of the foregoing. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing. In any prior embodiment or combination of embodiments, the support layer includes the metallic material; and the protective layer includes the polymeric material. In any prior embodiment or combination of embodiments, the support layer includes the polymeric material; and the protective layer includes the metallic material. In any prior embodiment or combination of embodiments, the core is present in an amount of 5 to 80 vol %, the support layer is present in an amount of 20 to 95 vol %, and the protective layer is present in an amount of 0.1 to 20 vol %, each based on the total volume of the multilayered unit. In any prior embodiment or combination of embodiments, a downhole assembly includes the downhole article.

Various embodiments of the disclosure further include a downhole assembly including a first component and a multilayered unit disposed on a surface of the first component, the multilayered unit including: a core comprising an energetic material and an activator; a support layer disposed on the core; and a protective layer disposed on the support layer, wherein the support layer and the protective layer each independently includes a polymeric material, a metallic material, or a combination comprising at least one of the foregoing, provided that the support layer is compositionally different from the protective layer. In any prior embodiment or combination of embodiments, the downhole assembly further includes a second component, and the multilayer unit is disposed between the first and second components. In any prior embodiment or combination of embodiments, the activator is a device that is effective to generate spark, electrical current, or a combination thereof to active the energetic material. In any prior embodiment or combination of embodiments, the first component, the second component, or both include Zn, Mg, Al, Mn, an alloy thereof, or a combination comprising at least one of the foregoing. In any prior embodiment or combination of embodiments, the multilayered unit has at least one stress concentration location. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing.

Various embodiments of the disclosure further include a method of controllably removing a downhole article, the method including: disposing a downhole article of any one of the previous embodiments in a downhole environment; performing a downhole operation; activating the energetic material; and disintegrating the downhole article. In any prior embodiment or combination of embodiments, disintegrating the downhole article comprises breaking the downhole article into a plurality of discrete pieces; and the method further includes corroding the discrete pieces in a downhole fluid. In any prior embodiment or combination of embodiments, activating the energetic material includes triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Various embodiments of the disclosure further include a method of controllably removing a downhole assembly, the method including: disposing a downhole assembly of any one of the previous embodiments in a downhole environment; performing a downhole operation; activating the energetic material in the multilayered unit; and disintegrating the downhole assembly. In any prior embodiment or combination of embodiments, disintegrating the downhole assembly comprises breaking the downhole assembly into a plurality of discrete pieces; and the method further includes corroding the discrete pieces in a downhole fluid. In any prior embodiment or combination of embodiments, activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Set forth below are various embodiments of the disclosure.

Embodiment 1

A downhole assembly includes a matrix material; and, a unit in contact with the matrix material, the unit including: a core comprising an energetic material; an activator disposed in direct contact with the core, the activator including a triggering system having an igniter and a pre-set timer connected in an electrical circuit; and, at least one layer disposed on the core; wherein the igniter is inactive in an open condition of the electrical circuit, and, after a pre-set time period, the pre-set timer closes the electrical circuit and the igniter is activated.

Embodiment 2

The downhole assembly as in any prior embodiment or combination of embodiments, wherein the matrix material and the unit are packaged together in a self-contained downhole tool.

Embodiment 3

The downhole assembly as in any prior embodiment or combination of embodiments, wherein the electrical circuit further includes a battery, the battery arranged to provide electric current to set off the igniter in a closed condition of the circuit.

Embodiment 4

The downhole assembly as in any prior embodiment or combination of embodiments, wherein the timer includes a battery separate from the battery arranged to provide electric current to set off the igniter.

Embodiment 5

The downhole assembly as in any prior embodiment or combination of embodiments, wherein the matrix material is included in at least one component of a frac plug or in a flapper.

Embodiment 6

The downhole assembly as in any prior embodiment or combination of embodiments, further comprising a plurality of the units in contact with the matrix material.

Embodiment 7

The downhole assembly as in any prior embodiment or combination of embodiments, wherein the matrix material has a cellular nanomatrix, a plurality of dispersed particles dispersed in the cellular nanomatrix, and a solid-state bond layer extending through the cellular nanomatrix between the dispersed particles.

Embodiment 8

The downhole assembly as in any prior embodiment or combination of embodiments, wherein the unit is a multi-layered unit and the at least one layer includes a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

Embodiment 9

The downhole assembly as in any prior embodiment or combination of embodiments, wherein the support layer comprises the metallic material; and the protective layer comprises the polymeric material.

Embodiment 10

The downhole assembly as in any prior embodiment or combination of embodiments, wherein the unit has at least one stress concentration location and/or the matrix has a pre-crack around the unit.

Embodiment 11

The downhole assembly as in any prior embodiment or combination of embodiments, wherein the energetic material comprises a thermite, a thermate, a solid propellant fuel, or a combination comprising at least one of the foregoing.

Embodiment 12

The downhole assembly as in any prior embodiment or combination of embodiments, wherein the at least one layer separates the matrix material from the unit.

Embodiment 13

The downhole assembly as in any prior embodiment or combination of embodiments, wherein the activator is disposed within the core.

Embodiment 14

A method of controllably removing a downhole tool, the method including setting the timer of the downhole assembly of any prior embodiment or combination of embodiments, for a first time period at a surface location; disposing the downhole assembly in a downhole environment; completing a downhole operation using the downhole tool within a second time period less than the first time period, the downhole tool formed at least partially of the matrix material; closing the electrical circuit upon completion of the first time period to activate the igniter; and activating the energetic material by the igniter and degrading the matrix material of the downhole tool.

Embodiment 15

A method of controllably removing a downhole article of a downhole assembly, the method including: setting a timer of the downhole article for a first time period, the downhole article including a degradable-on-demand material having a matrix material and a unit in contact with the matrix material, the unit including a core formed of an energetic material, a triggering system in direct contact with the core, and at least one layer on the core, the energetic material configured to generate energy upon activation to facilitate the degradation of the downhole article; disposing the downhole assembly in a downhole environment; performing a downhole operation using the downhole article during a second time period shorter than the first time period; activating the energetic material at the end of the first time period using an igniter of the triggering system; and degrading the downhole article.

Embodiment 16

The method as in any prior embodiment or combination of embodiments, wherein the triggering system includes an electrical circuit that further includes the igniter and a battery, and at the end of the first time period, the timer closes the electrical circuit and the battery provides electric current to activate the igniter.

Embodiment 17

The method as in any prior embodiment or combination of embodiments, wherein the triggering system is disposed within the core.

Embodiment 18

A downhole assembly including: a tubing string having a flowbore; and, a fluid loss control flapper pivotally connected to the tubing string at a hinge, the flapper formed of a degradable-on-demand material including: a matrix material; and, a unit in contact with the matrix material, the unit including: a core comprising an energetic material; and, an activator disposed in direct contact with the core, the activator including a triggering system having an igniter and a pre-set timer connected in an electrical circuit; wherein the igniter is inactive in an open condition of the electrical circuit, and, after a pre-set time period, the pre-set timer closes the electrical circuit and the igniter is activated.

Embodiment 19

The downhole assembly as in any prior embodiment or combination of embodiments, further comprising at least one layer disposed on the core, the at least one layer separating the matrix material from the core.

Embodiment 20

The downhole assembly as in any prior embodiment or combination of embodiments, wherein the activator is disposed within the core, and the unit is disposed within the flapper.

Embodiment 21

A frac plug including at least one component formed of a degradable-on-demand material including: a matrix material; and, a unit in contact with the matrix material, the unit including: a core including an energetic material; and, an activator disposed in direct contact with the core, the activator including a triggering system having an igniter and a pre-set timer connected in an electrical circuit; wherein the igniter is inactive in an open condition of the electrical circuit, and, after a pre-set time period, the pre-set timer closes the electrical circuit and the igniter is activated.

Embodiment 22

The frac plug as in any prior embodiment or combination of embodiments, wherein the at least one component is at least one first component, and further comprising at least one second component formed of the matrix material, the at least one second component not including the unit, and the at least one second component in contact with the at least one first component.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly comprising:

a matrix material; and, a unit in contact with the matrix material and embedded in the matrix material, the unit including:

a core comprising an energetic material configured to generate energy upon activation to facilitate degradation of the matrix material;

an activator disposed in direct contact with the core, the activator including a triggering system having an igniter and a pre-set timer connected in an electrical circuit; and, at least one layer disposed on the core;

wherein the igniter is inactive in an open condition of the electrical circuit, and, after a pre-set time period, the pre-set timer closes the electrical circuit and the igniter is activated.

2. The downhole assembly of claim 1, wherein the matrix material and the unit are packaged together in a self-contained downhole tool.

3. The downhole assembly of claim 1, wherein the electrical circuit further includes a battery, the battery arranged to provide electric current to set off the igniter in a closed condition of the circuit.

4. The downhole assembly of claim 3, wherein the timer includes a battery separate from the battery arranged to provide electric current to set off the igniter.

5. The downhole assembly of claim 1, wherein the matrix material is included in at least one component of a frac plug or in a flapper.

6. The downhole assembly of claim 1, further comprising a plurality of the units in contact with the matrix material within a downhole tool.

7. The downhole assembly of claim 1, wherein the matrix material has a cellular nanomatrix, a plurality of dispersed particles dispersed in the cellular nanomatrix, and a solid-state bond layer extending through the cellular nanomatrix between the dispersed particles.

8. The downhole assembly of claim 1, wherein the unit is a multi-layered unit and the at least one layer includes a support layer disposed on the core; and a protective layer disposed on the support layer, wherein the support layer and the protective layer each independently comprises a polymeric material, a metallic material, or a combination comprising at least one of the foregoing, provided that the support layer includes a different material from the protective layer.

9. The downhole assembly of claim 8, wherein the support layer comprises the metallic material; and the protective layer comprises the polymeric material.

10. The downhole assembly of claim 1, further comprising at least one of at least one stress concentration location at the unit and a pre-crack around the unit in the matrix material.

11. The downhole assembly of claim 1, wherein the energetic material comprises a thermite, a thermate, a solid propellant fuel, or a combination comprising at least one of the foregoing.

12. The downhole assembly of claim 1, wherein the at least one layer separates the matrix material from the unit.

13. The downhole assembly of claim 1, wherein the activator is disposed within the core.

14. A method of controllably removing a downhole tool, the method comprising:

setting the timer of the downhole assembly of claim 1 for a first time period at a surface location;

disposing the downhole assembly in a downhole environment;

completing a downhole operation using the downhole tool within a second time period less than the first time period, the downhole tool formed at least partially of the matrix material;

closing the electrical circuit upon completion of the first time period to activate the igniter; and activating the energetic material by the igniter and facilitating degradation of the matrix material of the downhole tool when the energetic material is activated.

15. A method of controllably removing a downhole article of a downhole assembly, the method comprising:

setting a timer of the downhole article for a first time period, the downhole article including a degradable-on-demand material having a matrix material and a unit in contact with the matrix material and embedded in the matrix material, the unit including a core formed of an energetic material configured to generate energy upon activation to facilitate degradation of the downhole tool, a triggering system in direct contact with the core, and at least one layer on the core, the energetic material configured to generate energy upon activation to facilitate the degradation of the downhole article;

disposing the downhole assembly in a downhole environment;

performing a downhole operation using the downhole article during a second time period shorter than the first time period;

activating the energetic material at the end of the first time period using an igniter of the triggering system; and facilitating degradation of the matrix material of the downhole article when the energetic material is activated.

16. The method of claim 15, wherein the triggering system includes an electrical circuit that further includes the igniter and a battery, and at the end of the first time period, the timer closes the electrical circuit and the battery provides electric current to activate the igniter.

17. The method of claim 15, wherein the triggering system is disposed within the core.

18. A downhole assembly comprising:

a tubing string having a flowbore; and, a fluid loss control flapper pivotally connected to the tubing string at a hinge, the flapper formed of a degradable-on-demand material including:

a matrix material; and, a unit in contact with the matrix material and embedded within the matrix material, the unit including:

a core comprising an energetic material configured to generate energy upon activation to facilitate degradation of the downhole tool; and, an activator disposed in direct contact with the core, the activator including a triggering system having an igniter and a pre-set timer connected in an electrical circuit;

wherein the igniter is inactive in an open condition of the electrical circuit, and, after a pre-set time period, the pre-set timer closes the electrical circuit and the igniter is activated.

19. The downhole assembly of claim 18, further comprising at least one layer disposed on the core, the at least one layer separating the matrix material from the core.

20. The downhole assembly of claim 18, wherein the activator is disposed within the core, and the unit is disposed within the flapper.

21. A frac plug comprising:

at least one component formed of a degradable-on-demand material including:

a matrix material; and, a unit in contact with the matrix material and embedded within the matrix material, the unit including:

a core comprising an energetic material configured to generate energy upon activation to facilitate degradation of the downhole tool; and, an activator disposed in direct contact with the core, the activator including a triggering system having an igniter and a pre-set timer connected in an electrical circuit;

wherein the igniter is inactive in an open condition of the electrical circuit, and, after a pre-set time period, the pre-set timer closes the electrical circuit and the igniter is activated.

22. The frac plug of claim 21, wherein the at least one component is at least one first component, and further comprising at least one second component of the frac plug formed of the matrix material, the at least one second component not including the unit, and the at least one second component in contact with the at least one first component.

* * * * *